US006901895B2

(12) United States Patent
Mae et al.

(10) Patent No.: US 6,901,895 B2
(45) Date of Patent: Jun. 7, 2005

(54) CAMSHAFT ROTATIONAL DETECTION STRUCTURE

(75) Inventors: Yosuke Mae, Yokohama (JP); Tomokazu Komatsuzaki, Chigasaki (JP)

(73) Assignees: Nissan Motor Co., Ltd., Yokohama (JP); Renault s.a.s. societe par actions simpliflee, Boulogne-Billancourt (FR)

( * ) Notice: Subject to any disclaimer, the term of this patent is extended or adjusted under 35 U.S.C. 154(b) by 0 days.

(21) Appl. No.: 10/817,971

(22) Filed: Apr. 6, 2004

(65) Prior Publication Data

US 2004/0211376 A1 Oct. 28, 2004

(30) Foreign Application Priority Data

Apr. 22, 2003 (JP) ..... 2003-116686

(51) Int. Cl.[7] ..... F01L 1/02

(52) U.S. Cl. ..... 123/90.31; 123/90.17; 123/90.27; 123/90.6; 74/567

(58) Field of Search ..... 123/90.15–90.17, 123/90.27, 90.31, 90.6; 73/116, 117.2, 117.3; 74/567; 29/888.1

(56) References Cited

U.S. PATENT DOCUMENTS 4,827,886 A * 5/1989 Maeda ..... 73/116
5,673,659 A * 10/1997 Regueiro ..... 123/90.17
5,860,328 A * 1/1999 Regueiro ..... 74/568 R
5,862,505 A * 1/1999 Fujiki ..... 73/116
6,041,647 A * 3/2000 Matsuoka ..... 73/116
6,286,365 B1 * 9/2001 Lang et al. ..... 73/116
6,343,580 B2 2/2002 Uchida
6,481,270 B1 11/2002 Kobayashi et al.

FOREIGN PATENT DOCUMENTS

JP 2001-073826 A 3/2001
JP 2001-329885 A 11/2001

* cited by examiner

*Primary Examiner*—Thomas Denion
*Assistant Examiner*—Kyle M. Riddle
(74) *Attorney, Agent, or Firm*—Shinjyu Global IP Counselors, LLP

(57) ABSTRACT

A camshaft rotational detection structure is configured that can improve the precision with which the camshaft rotational angle is detected. The camshaft rotational detection structure detects the rotational angle of a camshaft to which rotation is transmitted from the crankshaft of an engine through a cam sprocket mechanism. The camshaft rotational detection structure is provided with a cam thrust flange, a detection target, and a sensor. The cam thrust flange is provided on the camshaft near the end of the camshaft where the cam sprocket mechanism exists and serves to restrict axial movement of the camshaft. The detection target is provided on the cam thrust flange. The sensor is arranged facing opposite the detection target and is configured to detect the rotational angle of the camshaft.

9 Claims, 7 Drawing Sheets

CAMSHAFT ROTATIONAL DETECTION STRUCTURE

BACKGROUND OF THE INVENTION

1. Field of the Invention

The present invention relates to a camshaft rotational detection structure. More particularly, the present invention relates to a camshaft rotational detection structure configured to detect the rotational angle of a camshaft to which rotation is transmitted from the crankshaft of an engine through a cam sprocket mechanism.

2. Background Information

In DOHC multi-cylinder engines, two parallel camshafts for operating the intake valves and exhaust valves are arranged on the cylinder head of the engine and a sensor is mounted on each camshaft to detect the camshaft rotational angle for the purposes of identifying the cylinders and controlling the valve timing. An example of a mounting structure for this kind of sensor is presented in Japanese Laid-Open Patent Publication No. 2001-329885 (page 4 and FIG. 3). The sensor mounting structure described in that document has a first shaft bearing and a second shaft bearing provided on the camshaft near the cam sprocket mechanism and thrust bearings for restricting axial movement of the camshaft provided axially in front of and behind the first shaft bearing. A shutter (detection target) is also provided between the first and second shaft bearings separately from the thrust bearings, and the sensor is arranged facing opposite the shutter.

In view of the above, it will be apparent to those skilled in the art from this disclosure that there exists a need for an improved camshaft rotational detection structure. This invention addresses this need in the art as well as other needs, which will become apparent to those skilled in the art from this disclosure.

SUMMARY OF THE INVENTION

It has been discovered that in the camshaft rotational detection structure described in Japanese Laid-Open Patent Publication No. 2001-329885 (page 4 and FIG. 3), the shutter (detection target) is positioned so as to be axially separated from the thrust bearings. If the camshaft thermally expands in the axial direction when the engine is running, the camshaft will expand axially from the thrust bearings. Consequently, the shutter (detection target), which is provided on the camshaft, will shift axially out of position. As a result, the sensor position and shutter position will shift axially apart and invite the possibility that the precision with which the rotational angle of the camshaft is detected will decline.

Additionally, since the shutter (detection target) is provided separately from the thrust bearings that restrict the axial movement of the camshaft, the camshaft is longer and heavier than it might otherwise be.

Moreover, since thrust bearings are provided on both axially facing sides of the first shaft bearing, the camshaft is longer and heavier than it might otherwise be.

An object of the present invention is to provide a camshaft rotational detection structure that can improve the precision with which the camshaft rotational angle is detected.

Another object of the present invention is to provide a camshaft rotational detection structure that does not increase the weight of the camshaft.

A camshaft rotational detection structure in accordance with the present invention is provided that basically comprises a camshaft, a cam thrust flange, a detection target and a sensor. The camshaft has a cam sprocket mechanism attachment end.

The cam thrust flange is disposed on the camshaft near the cam sprocket mechanism attachment end. The cam thrust flange is configured and arranged to restrict axial movement of the camshaft. The detection target is disposed on the cam thrust flange. The sensor is configured and arranged to face opposite the detection target and to detect rotation of the camshaft.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
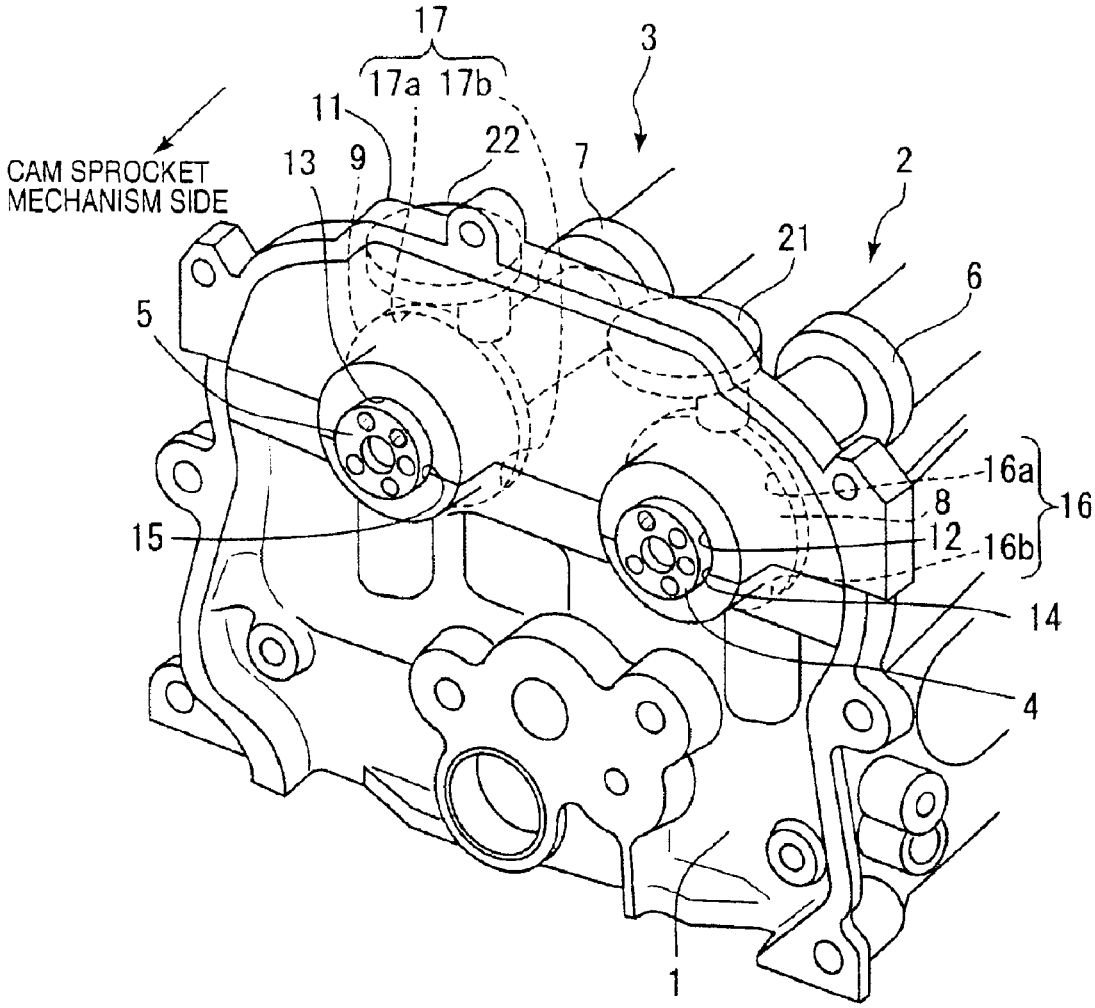
FIG. 1 is a partial perspective view of an engine cylinder head for an inline multi-cylinder DOHC engine having a camshaft rotational detection structure in accordance with the present invention.
Figure 2:
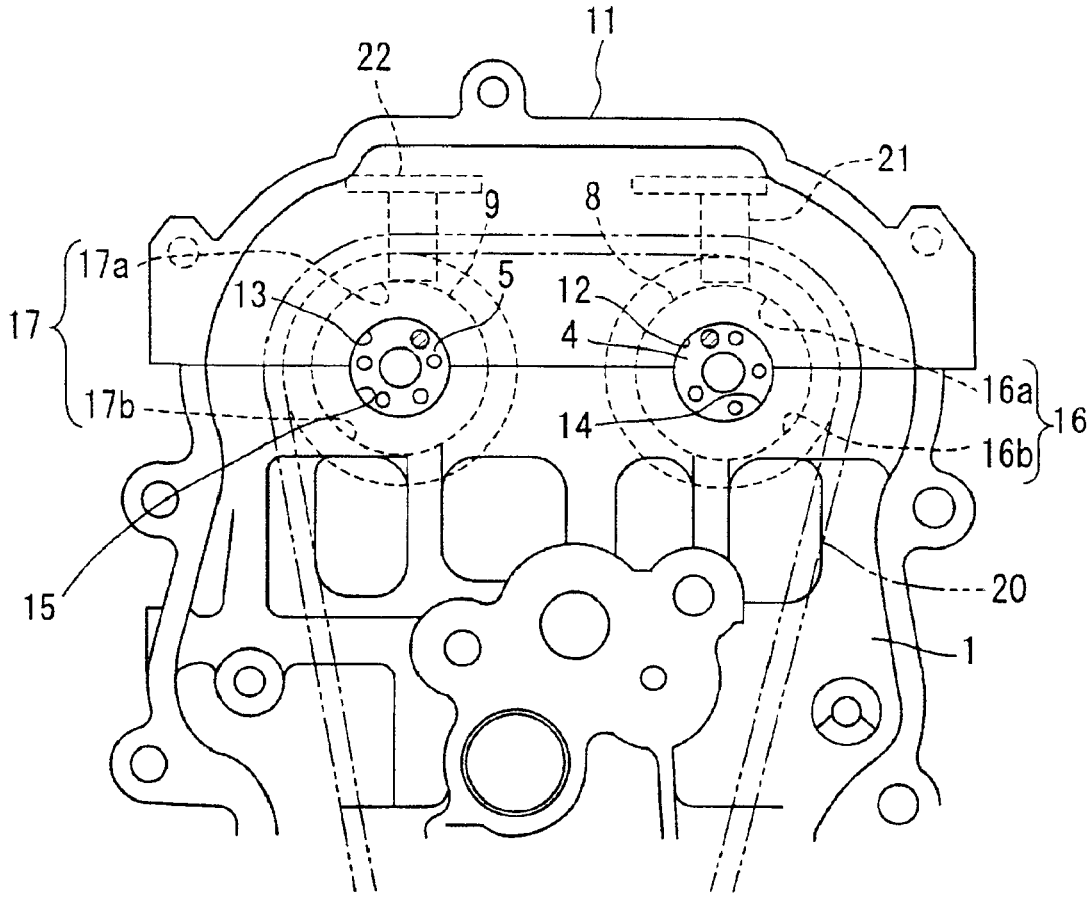
FIG. 2 is a partial front elevational view of the cylinder head illustrated in FIG. 1 with the camshaft rotational detection structure in accordance with the present invention.

Referring initially to FIGS. 1 to 4, an engine cylinder head 1 is illustrated for an inline multi-cylinder dual over head cam (DOHC) engine having a camshaft rotational detection structure in accordance with a first embodiment of the present invention. An intake camshaft 2 and an exhaust camshaft 3 are arranged on the upper surface of the cylinder head 1 in such a manner as to be substantially parallel to each other and parallel to a crankshaft (not shown). As shown in FIG. 2, one end of each of the camshafts 2 and 3 has a cam sprocket mechanism 20 mounted thereto in order to receive rotational input from the crankshaft. The intake camshaft 2 comprises a rod-shaped shaft main body 4, a plurality of cams 6 provided on the outside surface of the shaft main body 4, and a cam thrust flange 8 for restricting the axial movement of the shaft main body 4. Similarly, the exhaust camshaft 3 comprises a rod-shaped shaft main body 5, a plurality of cams 7 provided on the outside surface of the shaft main body 5, and a cam thrust flange 9 for restricting the axial movement of the shaft main body 5. As shown in FIG. 5, the cams 6 and the thrust flange 8 are formed integrally with the shaft main body 4 as a one-piece, unitary member, e.g. the cams 6 and the thrust flange 8 are machined or cast on the outside surface of the shaft main body 4. The cams 7 and the cam thrust flange 9 are formed integrally with on the shaft main body 5 as a one-piece, unitary member in the same manner as the intake camshaft 2.

Figure 3:
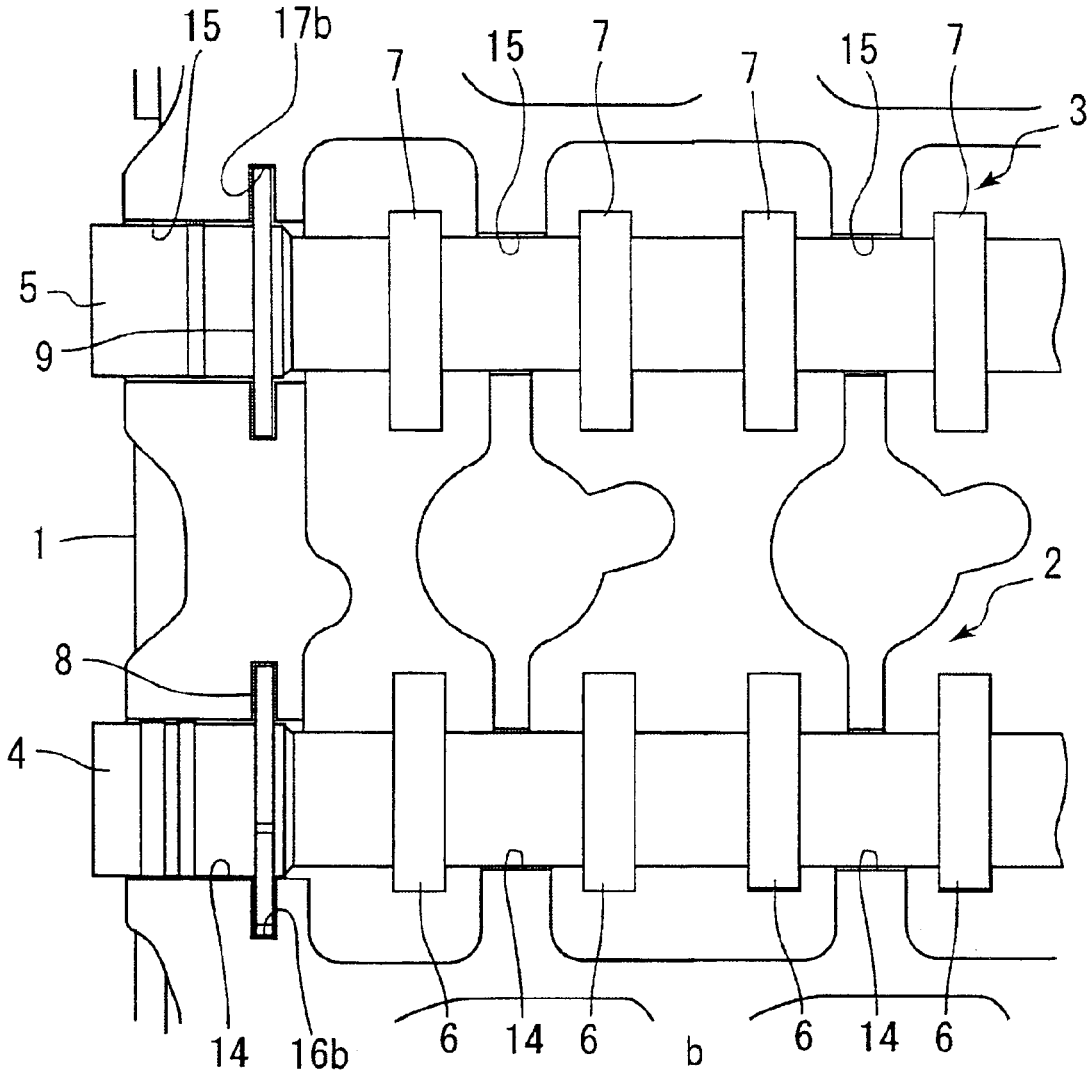
FIG. 3 is a partial top plan view of the cylinder head illustrated in FIG. 1 with selected portions removed to show the camshaft rotational detection structure in accordance with the present invention.

As shown in FIGS. 1 to 3, the upper surface of the cylinder head 1 has a plurality of lower shaft bearing parts 14 and 15 that are integrally formed on the upper surface of the cylinder head 1. The inside of each of the lower shaft bearing parts 14 and 15 has a semi-cylindrical bearing surface for supporting the lower half of one of the shaft main bodies 4 and 5, respectively. The camshafts 2 and 3 are rotatably retained on the upper surface of the cylinder head 1 by a plurality of cam brackets 10 and an end cam bracket 11. The cam brackets 10 and 11 are mounted to the cylinder head 1 to overlie the lower shaft bearing parts 14 and 15. The cam brackets 10 and 11 are each provided with upper shaft bearing parts 12 and 13 having semi-cylindrical bearing surfaces 16*a* and 16*b* for supporting the upper halves of the shaft main bodies 4 and 5. The upper shaft bearing parts 12 and 13 are arranged to correspond to the lower shaft bearing parts 14 and 15. Thus, the shaft main body 4 is supported in a freely rotatable manner by the bearing surfaces of the lower shaft bearing parts 14 and the upper shaft bearing parts 12. The shaft main body 5 is supported in a freely rotatable manner by the bearing surfaces of the lower shaft bearing parts 15 and the upper shaft bearing parts 13.

The upper surface of the cylinder head 1 has a pair of semi-circular grooves 16*b* and 17*b* into which the lower halves of the cam thrust flanges 8 and 9 are received, respectively. The semi-circular grooves 16*b* and 17*b* are formed in the bearing surfaces of the lower shaft bearing parts 14 and 15 that are disposed at the ends near the cam sprocket mechanisms 20. In other words, the lower shaft bearing parts 14 and 15 are positioned farther to the outside than the cams 6 and 7 that are closest to the cam sprocket mechanisms 20.

As shown in FIGS. 1 and 2, two semi-circular grooves 16*a* and 17*a* are formed in the cam bracket 11 that receive the upper half of the cam thrust flanges 8 and 9, respectively. Thus, the semi-circular grooves 16*a* and 17*a* are formed in the bearing surfaces of the upper shaft bearing parts 12 and 13 provided on the cam bracket 11. The semi-circular grooves 16*a* and 17*a* are arranged to correspond to the grooves 16*b* and 17*b* formed in the lower shaft bearing parts 14 and 15. The upper and lower grooves 16*a* and 16*b* form an annular groove 16, while the upper and lower grooves 17*a* and 17*b* form annular groove 17. The lower halves of the cam thrust flanges 8 and 9 are inserted into the grooves 16*b* and 17*b* when the camshafts 2 and 3 are arranged on the shaft bearing surfaces of the lower shaft bearing parts 14 and 15. The upper halves of the cam thrust flanges 8 and 9 are inserted into the grooves 16*a* and 17*a* when the cam bracket 11 is mounted onto the lower shaft bearing parts 14 and 15. Thus, the cam thrust flanges 8 and 9 are disposed into the annular grooves 16 and 17 in a freely sliding or rotating manner.

Figure 4:
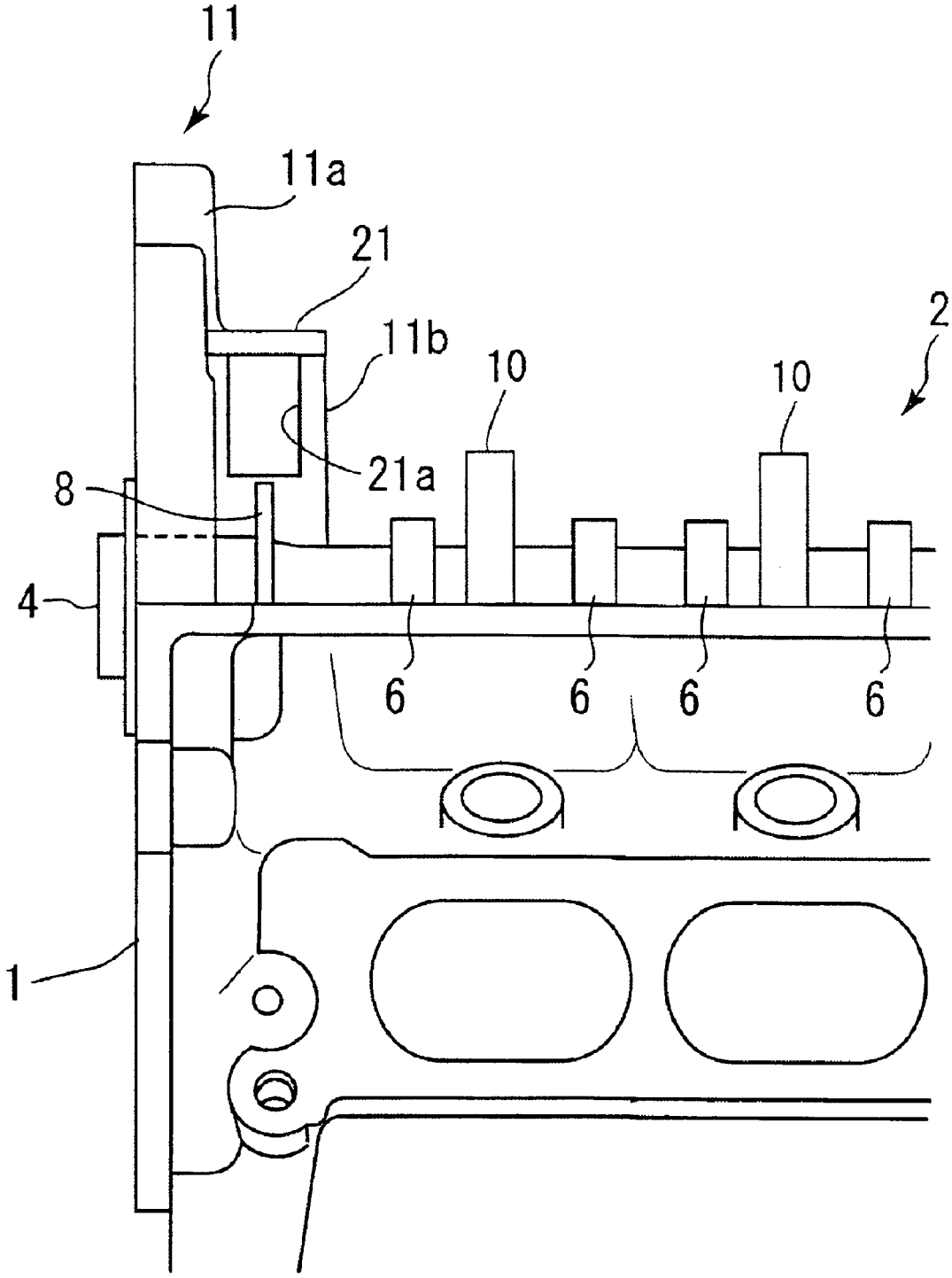
FIG. 4 is a partial side elevational view of the cylinder head illustrated in FIG. 1 with the camshaft rotational detection structure in accordance with the present invention.
Figure 5:
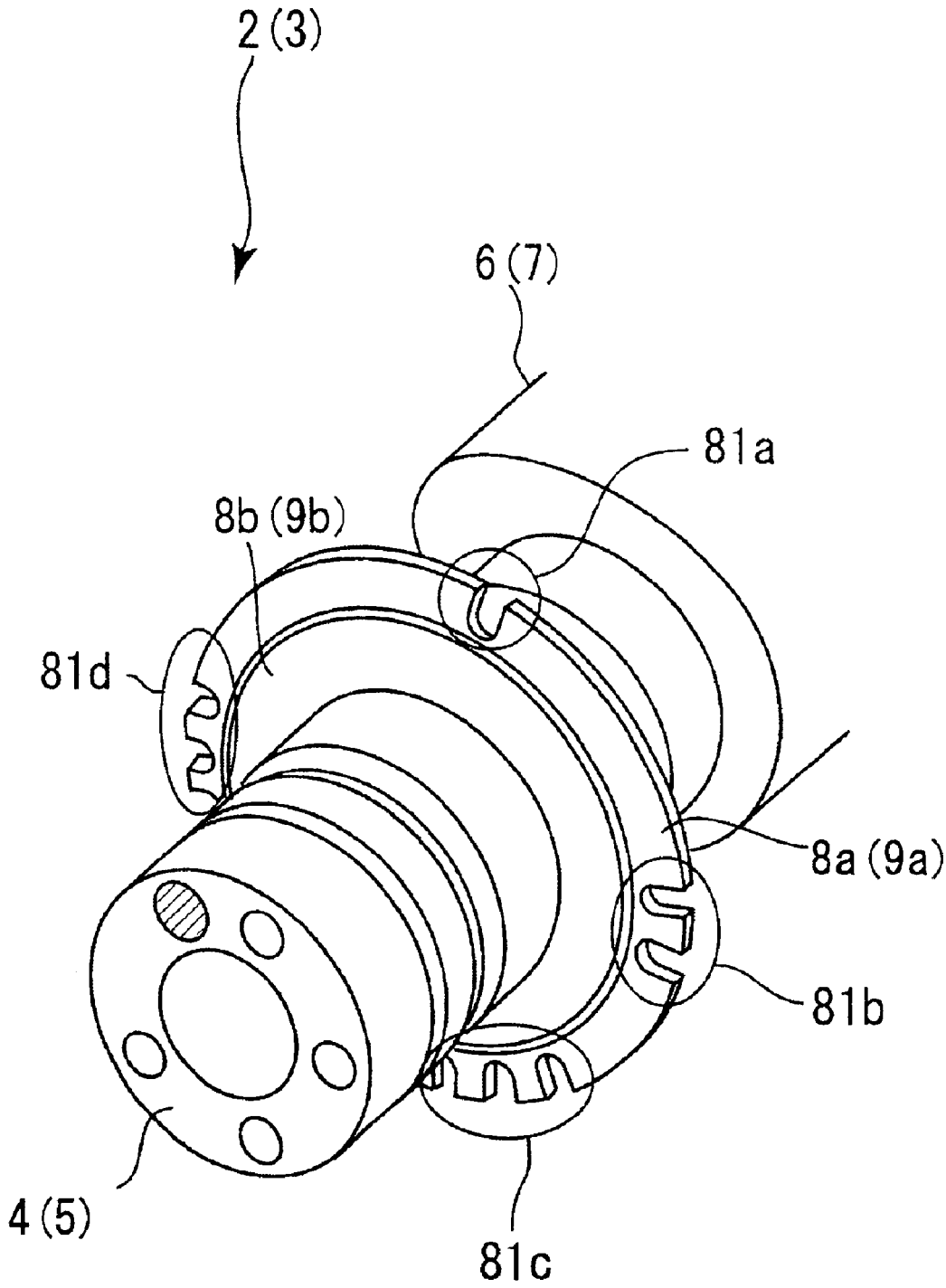
FIG. 5 is an enlarged partial perspective view of the camshaft illustrated in FIG. 1 with the camshaft rotational detection structure in accordance with the present invention.

As shown in FIG. 4, the cam bracket 11 that overlie the lower shaft bearing parts 14 and 15 positioned closest to the cam sprocket mechanisms 20 supports a pair of sensors or sensing devices 21. In particular, this cam bracket 11 comprises a bracket main body section 1 la and a cover section 11*b*. The bracket main body section 11*a* is configured and arranged to mount a chain cover (not shown) thereon. The cover section 11*b* extends from the bottom of the bracket main body 11*a* in the vertical direction and faces axially inward toward the cylinder head 1.

Figure 6:
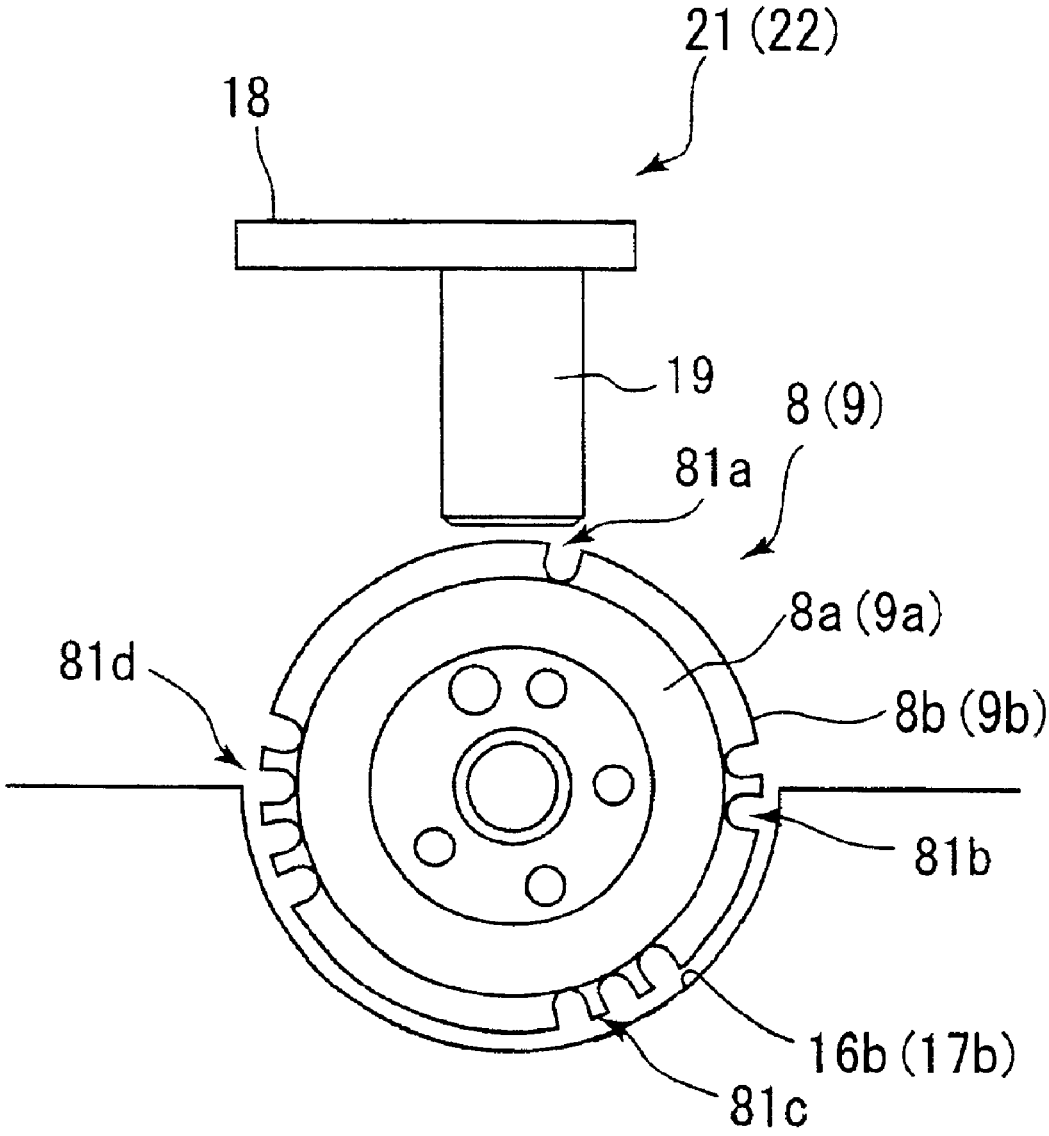
FIG. 6 is a partial front elevational view illustrating the positioning relationship between the cam thrust flange and the sensor illustrated in FIG. 1 for the camshaft rotational detection structure in accordance with the present invention.

As shown in FIGS. 2, 4 and 6, the sensor or sensing devices 21 are mounted to the cover sections 11*b* above the camshafts 2 and 3 to detect the rotational angles of the cams 6 and 7, respectively. Each of the sensors 21 comprises a mounting flange 18 and a sensor main unit 19. Each of the cover sections 11*b* has a sensor mounting section 21*a* with an insertion hole that opens above the cam thrust flange 8 or 9. The sensor main unit 19 is inserted into the insertion hole facing downward and the mounting flange 18 is fixed to the cover section 11*b*.

Figure 7:
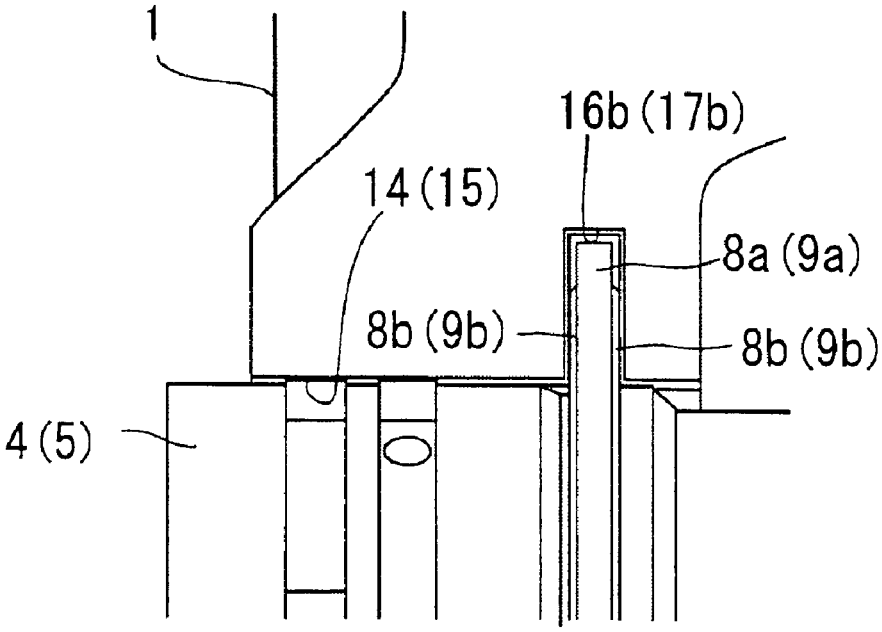
FIG. 7 is a partial top plan view illustrating the positioning relationship between the cam thrust flange and the cylinder head illustrated in FIG. 1 for the camshaft rotational detection structure in accordance with the present invention.

The cam thrust flanges 8 and 9 are formed in the shape of a circular disk, as shown in FIGS. 5 to 7. The cam thrust flange 8 comprises an outer circumferential section 8*a* and an inner circumferential section 8*b* whose thicknesses are different. The outer circumferential section 8*a* is thinner than the inner circumferential section 8*b* such that a step is formed such the full circumference between the outer circumferential section 8*a* and the inner circumferential section 8*b* on both lateral faces of the cam thrust flange 8. The outside diameter of the outer circumferential section 8*a* is larger than the outside diameters of the shaft main body 4, the cams 6, and all other components of the camshaft 2. As shown in FIG. 7, the width of the groove 16*b* (width of annular groove 16) is uniform. Thus, when the cam thrust flange 8 is inserted into the annular groove 16, the inner circumferential section 8*b* forms a comparatively small first gap with the inside walls of the groove 16 and slides therebetween. Also the outer circumferential section 8*a* forms a second gap (larger than the first gap) with the inside walls of the annular groove 16 and does not contact the inside walls of the groove 16. The inside diameter of the annular groove 16 is larger than the outside diameter of the cam thrust flange 8 and does not contact the edge of the outer circumferential section 8*a* of the cam thrust flange 8. This cam thrust flange 8 rotates integrally with the shaft main body 4, while the inner circumferential section 8*b* and the inside walls of the annular groove 16 restrict axial movement of the camshaft 2 and serve to position the camshaft 2 in the axial direction.

As shown in FIGS. 5 and 6, radially-outward opening notched sections 81*a* to 81*d* are formed with substantially equal spacing in the outer circumferential sections 8*a* of the cam thrust flange 8. The notched sections 81*a* to 81*d* have one, two, three and four notches, respectively. The notched sections 81*a* to 81*d* of the cam thrust flange 8 constitute a sensor or detection target 81 used for detecting the rotational angles of the cams 6. The sensor 21 is arranged to face opposite the detection target 81 of the cam thrust flange 8 . The sensor 21 is configured to detect the rotational angles of the cams 6 by detecting the notched sections 81*a* to 81*d* of the detection target 81. Thus, the detection target 81 is provided on the cam thrust flange 8. The shaft bearing parts 12 and 14 form the annular groove 16 into which the cam thrust flange 8 is inserted in a freely sliding manner, while the sensor 21 constitute the cam rotational angle detection structure for detecting the rotational angle of the cams 6.

The cam thrust flange 9 of the exhaust camshaft 3 is formed in a similar manner to the cam thrust flange 8 and its axial movement is restricted by the inside walls of the annular groove 17. A sensor target is provided on the outer circumferential section of the cam thrust flange 9 in a similar manner to the cam thrust flange 8 and a sensor 22 detects the rotational angle of the camshaft 3. When it is not necessary to detect the rotational angle of the exhaust camshaft 3, it is not necessary to provide a sensor target on the cam thrust flange 9 or to provide a sensor 22.

Likewise, the cam thrust flange 9 comprises an outer circumferential section 9*a* and an inner circumferential section 9*b* whose thicknesses are different. The outer circumferential section 9*a* is thinner than the inner circumferential section 9*b* such that a step is formed such the full circumference between the outer circumferential section 9*a* and the inner circumferential section 9*b* on both lateral faces of the cam thrust flange 9. The outside diameter of the outer circumferential section 9*a* is larger than the outside diameters of the shaft main body 5, the cams 7, and all other components of the camshaft 3. As shown in FIG. 7, the width of the groove 17*b* (width of annular groove 17) is uniform. Thus, when the cam thrust flange 9 is inserted into the annular groove 17, the inner circumferential section 9*b* forms a comparatively small first gap with the inside walls of the groove 17 and slides therebetween. Also the outer circumferential section 9*a* forms a second gap (larger than the first gap) with the inside walls of the annular groove 17 and does not contact the inside walls of the groove 17. The inside diameter of the annular groove 17 is larger than the outside diameter of the cam thrust flange 9 and does not contact the edge of the outer circumferential section 9*a* of the cam thrust flange 9. This cam thrust flange 9 rotates integrally with the shaft main body 5, while the inner circumferential section 9*b* and the inside walls of the annular groove 17 restrict axial movement of the camshaft 3 and serve to position the camshaft 3 in the axial direction.

The sensor 22 is arranged to face opposite the detection target 81 of the cam thrust flange 9. The sensor 22 is configured to detect the rotational angles of the cams 7 by detecting the notched sections 81*a* to 81*d* of the detection target 81. Thus, the detection target 81 is provided on the cam thrust flange 9. The shaft bearing parts 13 and 15 form the annular groove 17 into which the cam thrust flange 9 is inserted in a freely sliding manner, while the sensor 22 constitute the cam rotational angle detection structure for detecting the rotational angle of the cams 7.

Also, although in this embodiment a separate cam bracket 10 is provided for each cylinder, it is also acceptable to combine the cam brackets 10 and 11 into a single unit that spans across all of the cylinders. Such an arrangement will improve the rigidity of the cam brackets.

With a cam rotational angle detection structure configured as described heretofore, when the crankshaft rotation is imparted to the cam sprocket mechanism 20 and the cam sprocket mechanism 20 rotates the camshaft 2, the camshaft 2 rotates while sliding on a shaft bearing surface and the inner circumferential section 8*b* of the cam thrust flange 8 rotates while sliding along the inside walls of the annular groove 16 formed in the shaft bearing surface. The sensor 21 detects the rotational angle of the cams 6 by detecting the detection target 81 formed on the outer circumferential section 8*a* of the cam thrust flange 8.

With this cam rotational angle detection structure, the sensor or detection target 81 is provided on the cam thrust flange 8 or 9 that restricts the axial movement of the camshaft 2 or 3. Therefore, even if the camshaft 2 or 3 thermally expands in the axial direction when the engine is running, the camshaft 2 or 3 will expand axially from the cam thrust flange 8 or 9 and the detection target 81, which is provided on the cam thrust flange 8 or 9, will not shift axially out of position in conjunction with the thermal expansion. As a result, the rotational angle of the camshaft 2 can be detected with greater precision.

Also, if the cam thrust flange 8 or 9 and the detection target 81 were arranged to be separated from each other along the axial direction of the camshaft 2 or 3, there would be the possibility of the positional relationship between the detection target 81 and the sensor 21 being disturbed due to variation in the dimensions of the different parts of the camshaft 2 or 3. However, since the detection target 81 is provided on the thrust flange 8 or 9, disturbing of the positional relationship between the detection target 81 and the sensor 21 or 22 can be prevented.

Furthermore, since axial movement of the camshafts 2 and 3 is restricted by inserting the cam thrust flanges 8 and 9 into the annular groove 16 and 17 provided in the shaft bearing parts 12, 14, and 13, 15 it is not necessary to use a plurality of cam thrust flanges 8 and 9, the camshaft 2 and 3 can be shortened, and increasing the weight of the camshafts 2 and 3 can be avoided.

The detection sensitivity of the sensor 21 or 22 increases as the external diameter of the detection target 81 increases. Thus, the precision with which the cam rotational angle is detected is improved by providing the detection target 81 on the outer circumferential section 8*a* or 9*a* of the cam thrust flange 8 or 9, which is the component of the camshaft 2 or 3 having the largest outside diameter.

Since the detection target 81 is formed integrally with the cam thrust flange 8 or 9 by forming notched sections 81*a* to 81*d* in the outer circumferential section 8*a* or 9*a* of the cam thrust flange 8 or 9, the precision of the positioning of the detection target 81 can be improved. Also, the detection target 81 can be made easily because it comprises notched sections 81*a* to 81*d*.

Since the detection target 81 is provided on an outer circumferential section 8*a* or 9*a* of the cam thrust flange 8 or 9, which is formed such that step exists between the outer circumferential section 8*a* or 9*a* and the inner circumferential section 8*b* or 9*b* on both lateral faces of the cam thrust flange 8 or 9, the detection target 81 is configured such that it does not contact the cylinder head 1 (i.e., the inside wall of the annular groove 16 or 17). Therefore, when notched sections 81*a* to 81*d* of the detection target 81 are made using a cutting tool, flash remaining around the perimeter of the notched sections can be prevented from sticking to, scratching, or wearing the cylinder head 1. Also, the detection target 81 can be prevented from being damaged or worn. Additionally, the process of removing flash from the detection target 81 can be shortened and thus costs can be reduced. Furthermore, since the outer circumferential section 8*a* need only be as large as required to provide the detection target 81, a sufficiently large sliding surface can be secured for the inner circumferential section 8*b* or 9*b* and the surface pressure can be prevented from becoming too high.

Since the cam thrust flange 8 or 9 is formed integrally with the shaft main body 4 or 5, the precision of the positioning of the cam thrust flange 8 or 9 can be improved and the work of assembling the cam thrust flange 8 or 9 and the shaft main body 4 or 5 can be eliminated.

Since the annular groove 16 or 17 into which the cam thrust flange 8 or 9 (on which the detection target 81 is provided) is inserted and the sensor mounting section 21*a* into which the sensor 21 or 22 is inserted are formed integrally with the cam bracket 11, no additional interstitial parts are required to position the detection target 81 and the sensor 21 or 22. Consequently, disagreement between the positioning of the detection target 81 and the sensor 21 or 22 that would otherwise result from the cumulative effects of the dimensional tolerances of a plurality of parts and looseness in the mountings between them can be prevented and the detection precision achieved by the sensor 21 or 22 can be improved.

The Japanese Laid-Open Patent Publication No. 2001-73826 describes a camshaft rotational detection structure in which the cam thrust flange is arranged on the opposite side as the cam sprocket mechanism. When the cam thrust flange and the cam sprocket mechanism are arranged on opposite sides, the distance between the cam thrust flange and the cam sprocket mechanism is large. In such a configuration as that, if the camshaft expands from the cam thrust flange due to thermal expansion, the amount of axial movement of the cam sprocket mechanism will be large because the cam sprocket mechanism is positioned the farthest from the cam thrust flange and there will be the possibility that it will become impossible to transmit rotation from the crankshaft to the camshaft with good precision. Conversely, in a camshaft rotational detection structure according to this embodiment, the cam thrust flanges 8 and 9 are positioned by the grooves 16 and 17 that are provided in the cam bracket 11 that is closest to the cam sprocket mechanism 20. As a result, the distance between the cam thrust flange 8 and the cam sprocket mechanism 20 is small, the axial movement of the cam sprocket mechanism 20 resulting from thermal expansion of the camshafts 2 and 3 is small, and the rotation can be transmitted from the crankshaft to the camshafts 2 and 3 with good precision.

Although the operational effects of the rotational angle detection structure of the intake camshaft 2 are describe herein, the same operational effects are exhibited when the rotational angle of the exhaust camshaft 3 is detected.

Second Embodiment

Figure 8:
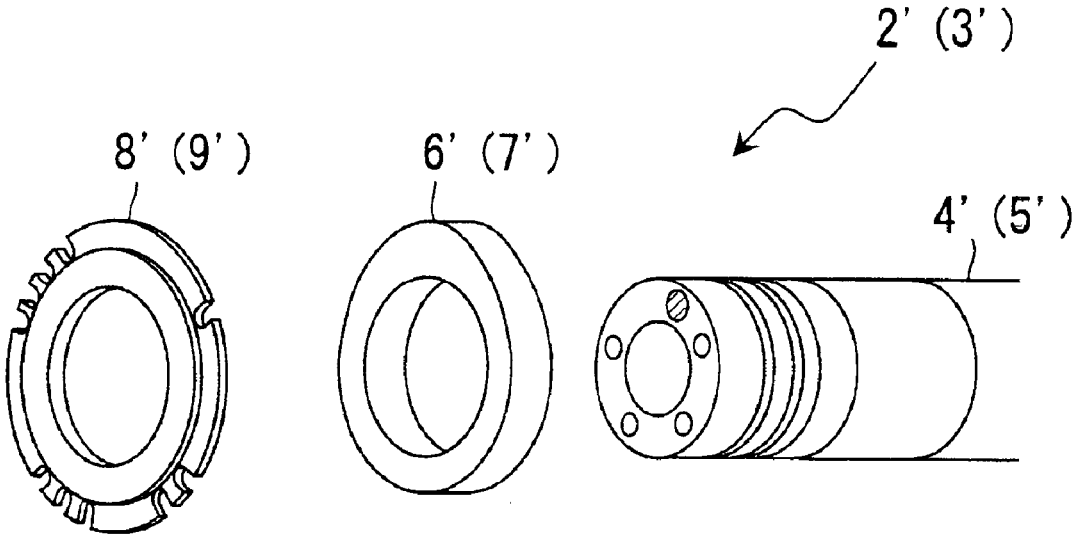
FIG. 8 is an exploded partial perspective view of an assembled shaft in accordance with a second embodiment of the present invention.

Referring now to FIG. 8, an end portion of a camshaft 2' (3') is illustrated in accordance with a second embodiment. In view of the similarity between the first and second embodiments, the descriptions of the parts of the second embodiment that are identical to the parts of the first embodiment may be omitted for the sake of brevity. Moreover, the parts of the second embodiment that are the same as the first embodiment will be given the same reference numeral, while the parts that differ from the parts of the first embodiment will be indicated with a single prime (').

In this second embodiment, the camshaft 2 (3) of the first embodiment has been replaced with the camshaft 2' (3') of FIG. 8. Thus, the remaining structure of the first embodiment is utilized with the camshaft 2' (3') of FIG. 8. In the previous embodiment, the cams 6 (7) and the cam thrust flange 8 (9) are formed integrally as a one-piece, unitary member with the shaft main bodies 4 (5). However, it is also acceptable for the camshaft 2' (3') to be an assembled shaft. In other words, the cams 6' (7') and the cam thrust flange 8' (9') are separately formed individual pieces that are fitted onto and secured to the shaft main body 4' (5') as shown in FIG. 8. It is also acceptable for only the cams 6' (7') or only the thrust flange 8' (9') to be formed as separate members.

With the assembled shaft shown in FIG. 8, although it is necessary to attach the cam thrust flange 8' (9') to the shaft main body 4' (5'), the detection target 81 is formed integrally with the cam thrust flange 8' (9') as a one-piece, unitary member. Consequently, the number of parts can be reduced and the manufacturing cost can be reduced in comparison with a case in which the detection target 81 is provided on a separate plate member. Also, even with the assembled camshaft 2' (3'), the positioning precision of the detection target 81 can be improved because the detection target 81 is formed integrally with the cam thrust flange 8' (9').

As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2003-116686. The entire disclosure of Japanese Patent Application No. 2003-116686 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A camshaft rotational detection structure comprising:

a camshaft having a cam sprocket mechanism attachment end;

a cam thrust flange disposed on the camshaft near the cam sprocket mechanism attachment end, the cam thrust flange being configured and arranged to restrict axial movement of the camshaft;

a detection target disposed on the cam thrust flange;

a sensor configured and arranged to face opposite the detection target and to detect rotation of the camshaft; and a shaft bearing including a groove with the cam thrust flange being disposed in the groove in a freely sliding manner, and the shaft bearing being configured to axially support the camshaft to rotate freely in the groove, the cam thrust flange including an inner circumferential section disposed in the groove to define a first gap therebetween, and an outer circumferential section disposed in the groove to define a second gap therebetween that is larger than the first gap, the outer and inner circumferential sections being further configured and arranged to form a step on both lateral faces between the outer circumferential section and the inner circumferential section.

2. The camshaft rotational detection structure as recited in claim 1, wherein the cam thrust flange has a larger outside diameter than any other portion of the camshaft.

3. The camshaft rotational detection structure as recited in claim 1, wherein the cam thrust flange and the detection target are integrally formed together as a one-piece, unitary member.

4. The camshaft rotational detection structure as recited in claim 3, wherein the detection target comprises a notched section formed in the outer circumferential section of the cam thrust flange.

5. The camshaft rotational detection structure as recited in claim 1 wherein the detection target is disposed on the outer circumferential section of the cam thrust flange.

6. The camshaft rotational detection structure as recited in claim 1, wherein the shaft bearing has a lower shaft bearing part that axially supports a lower half of the camshaft and an upper shaft bearing part that axially supports an upper half of the camshaft; and further comprising a sensor mounting section integrally formed on the upper shaft bearing part to support the sensor thereon.

7. The camshaft rotational detection structure as recited in claim 1, wherein the cam thrust flange and the camshaft are integrally formed together as a one-piece, unitary member.

8. The camshaft rotational detection structure as recited in claim 1, wherein the camshaft and the cam thrust flange are separate pieces that are assembled to form an assembled camshaft.

9. A camshaft rotational detection structure comprising:

camshaft means for moving a part;

cam thrust flange means for restricting axial movement of the camshaft means, the cam thrust flange means being configured and arranged on the camshaft means with a step formed on both lateral faces of the cam thrust flange means;

detection target means for providing detection target on the cam thrust flange means;

sensing means for detecting rotation of the camshaft means via the detection target means; and shaft bearing means for freely rotatably supporting the camshaft means such that the cam thrust flange means is disposed within the groove formed in the shaft bearing means in a freely sliding manner, the steps of the cam thrust flange being configured to define a first gap between an inner circumferential section of the cam thrust flange means and the groove and a second gap between an outer circumferential section of the cam thrust flange means and the groove such that the second gap is larger than the first gap.

* * * * *